US005709555A

United States Patent [19]

Noschese

[11] Patent Number: 5,709,555

[45] Date of Patent: Jan. 20, 1998

[54] HIGH DENSITY CARD EDGE CONNECTION SYSTEM WITH OUTRIGGER AND SEQUENTIALLY CONNECTED CONTACTS

[75] Inventor: Rocco J. Noschese, Wilton, Conn.

[73] Assignee: Framatome Connectors USA Inc., Fairfield, Conn.

[21] Appl. No.: 493,842

[22] Filed: Jun. 22, 1995

[51] Int. Cl.[6] ..... H01R 9/09

[52] U.S. Cl. ..... 439/79; 439/924.1; 439/876; 29/830

[58] Field of Search ..... 29/830, 842; 439/59, 439/60, 489, 490, 924.1, 79, 876

[56] References Cited

U.S. PATENT DOCUMENTS 4,684,181 8/1987 Massit et al. ..... 439/59

4,867,690 9/1989 Thumma ..... 439/79

*Primary Examiner*—Neil Abrams

*Assistant Examiner*—Barry Matthew L. Standig

*Attorney, Agent, or Firm*—Perman & Green, LLP

[57] ABSTRACT

A method of connecting a combined daughter printed circuit board and outrigger assembly to a mother board. The assembly has an outrigger with a one piece housing. Contacts of the outrigger are aligned with contact pads on the daughter board by their carry strips prior to soldering the contacts to the contact pads. When the assembly is inserted into a receptacle on the mother board, five different types of contact pads on the card edge connection area are sequentially connected to contacts of the receptacle.

11 Claims, 3 Drawing Sheets

18
12
20
10
24f
22
16
A
B
C
D
E
24a
24b
24c
24d
24e

HIGH DENSITY CARD EDGE CONNECTION SYSTEM WITH OUTRIGGER AND SEQUENTIALLY CONNECTED CONTACTS

BACKGROUND OF THE INVENTION

1. Field of the Invention

The present invention relates to electrical connectors and, more particularly, to an outrigger edge connector for use in connecting a daughter printed circuit board to a mother printed circuit board.

2. Prior Art

U.S. Pat. No. 5,236,368 discloses a printed circuit board and outrigger edge connector assembly. U.S. Pat. No. 3,993,935 discloses a printed circuit board with four levels of contact pads. U.S. Pat. No. 4,849,944 discloses ground terminals on a printed circuit board that contact a connector before other contacts of the board to discharge static electricity. U.S. Pat. No. 4,993,972 discloses five levels of spring contacts. The following U.S. Patents disclose other types of connection schemes:

| | |
|---|---|
| 3,432,795 | 4,392,700 |
| 4,503,608 | 4,710,133 |
| 4,734,041 | 4,806,103 |
| 4,889,495 | 4,932,888 |
| 4,975,067 | 5,009,606 |
| 5,024,609 | 5,080,613 |
| 5,088,931 | 5,098,311 |
| 5,190,480 | |

SUMMARY OF THE INVENTION

In accordance with one method of the present invention a method of mechanically and electrically connecting a first electronic component to a second electronic component by inserting a portion of the second component into a receptacle of the first component is provided comprising steps of connecting a first ground contact, a second precharge contact, a third power contact, fourth signal contacts, and a fifth insertion confirmation contact of the second component with corresponding contacts of the first component at five separate sequential depths of insertion inside the receptacle.

In accordance with another method of the present invention a method of connecting a daughter printed circuit board to a mother printed circuit board is provided comprising steps of inserting a card edge connection area of the daughter board and an outrigger edge connector attached to the daughter board into a receptacle connector mounted on the mother board; and sequentially connecting at least five different types of contact pads on the card edge connection area to spring contacts in the receptacle connector at five depths of insertion into the receptacle connector.

In accordance with another method of the present invention a method of attaching upper contact areas of contacts on an outrigger edge connector with upper contact pads on a daughter printed circuit board is provided comprising steps of providing the outrigger edge connector with contacts having their upper contact areas connected to at least one carry strip; connecting the outrigger edge connector to the daughter board; aligning the carry strip with the daughter board and thereby aligning the upper contact areas with the upper contact pads on the daughter board; and soldering the upper contact areas to the upper contact pads.

In accordance with one embodiment of the present invention a combined daughter printed circuit board and outrigger connector assembly is provided comprising a daughter board and an outrigger connector. The daughter board has a card edge connection area. The outrigger connector is connected to the daughter board and has a housing and a plurality of electrical contacts. The housing is comprised of a one piece member with a slot having a portion of the daughter board passing therethrough and at least one ledge spaced from and parallel to the card edge connection area. The electrical contacts extend down alongside the at least one ledge.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
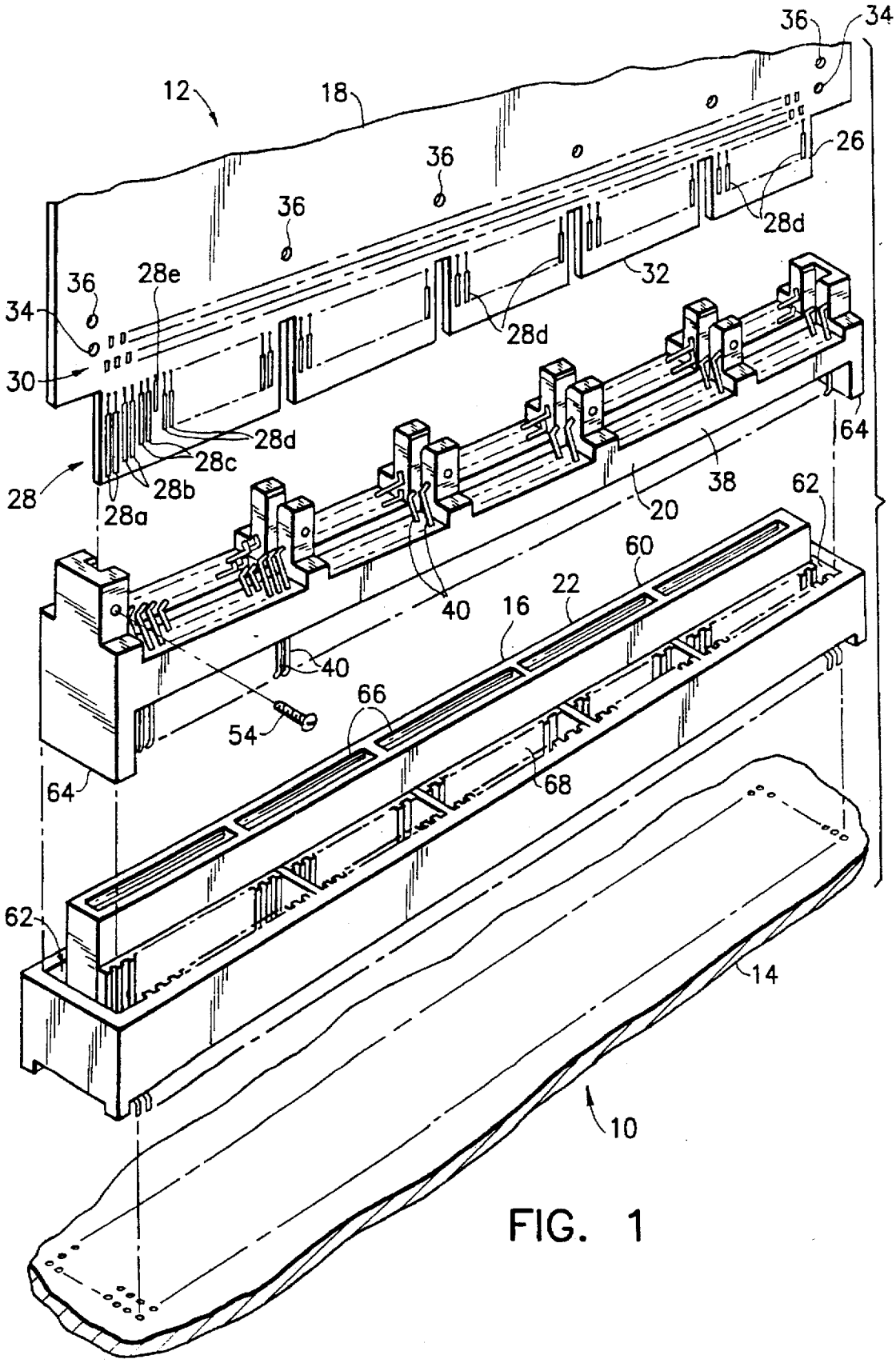
FIG. 1 is an exploded perspective view of portions of two electrical components incorporating features of the present invention.

Referring to FIG. 1, there is shown an exploded perspective view of two electrical components 10, 12 incorporating features of the present invention. Although the present invention will be described with reference to the single embodiment shown in drawings, the present invention may be embodied in many alternative forms of embodiments. In addition, any suitable size, shape or type of elements or material could be used.

In the embodiment shown, the first electronic component 10 includes a mother printed circuit board 14 and a card edge receptacle connector 16. The second electronic component 12 includes a daughter printed circuit board 18 and an outrigger edge connector 20. The receptacle connector 16 has a housing 22 with three parallel rows of receiving areas with spring contacts 24 (see FIG. 2A) therein. A center portion 60 of the housing 22 extends upward past the rest of the housing. The ends of the housing 22 have open areas 62 to receive end portions 64 of the outrigger 20. The center portion 60 has one of the rows of receiving areas 66 therein. The two other rows of receiving areas 68 (only one of which is shown) are located on opposite sides of the center portion 60.

The daughter board 18 has a card edge connection area 26. In the embodiment shown, the connection area 26 has a lower set of elongate contacts or contact pads 28 and an upper set of contact pads 30. The lower set 28 includes five different lengths of contact pads **28*a*, 28*b*, 28*c*, 28*d* and 28*e*. The first type of contact pads 28*a* are ground contact pads, are the longest of the contact pads 28, and are located closest to the leading edge 32 of the card edge connection area 26. The second type of contact pads 28*b* are precharge contact pads, are the second longest of the contact pads 28, and are the second closest to the leading edge 32. The third type of contact pads 28*c* are power contact pads, are the third longest of the contact pads 28, and are the third closest to the leading edge 32. The fourth type of contact pads 28***d* are signal contact pads, are the second shortest of the contacts 28, and are the fourth closest to the leading edge 32. The fifth type of contact pad 28*e* is an insertion confirmation contact pad, is the shortest of all the contact pads, and is the furthest of the contacts 28 from the leading edge 32. The upper set of contact pads 30 comprise two rows of signal contact pads. The daughter board 18 includes outrigger mounting holes 34 and alignment holes 36.

Figure 3:
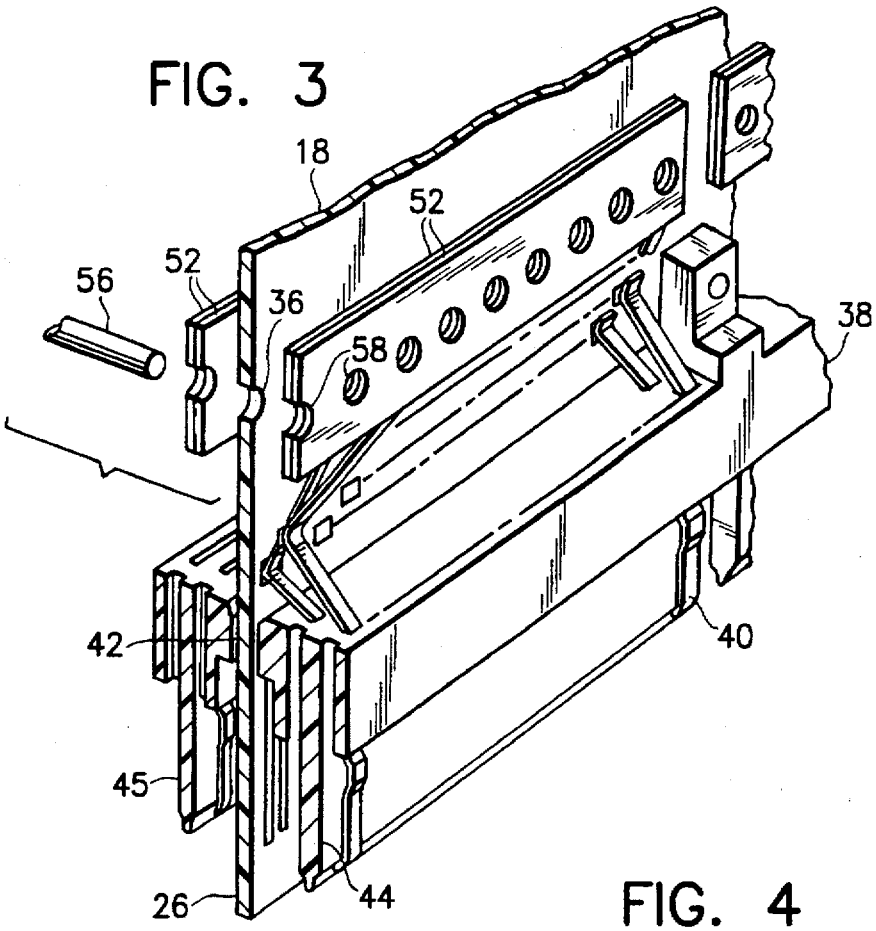
FIG. 3 is a partial perspective with a cut-away section of the daughter board and outrigger assembly shown in FIG. 1 showing the contact carry strips still attached to the contacts.
Figure 4:
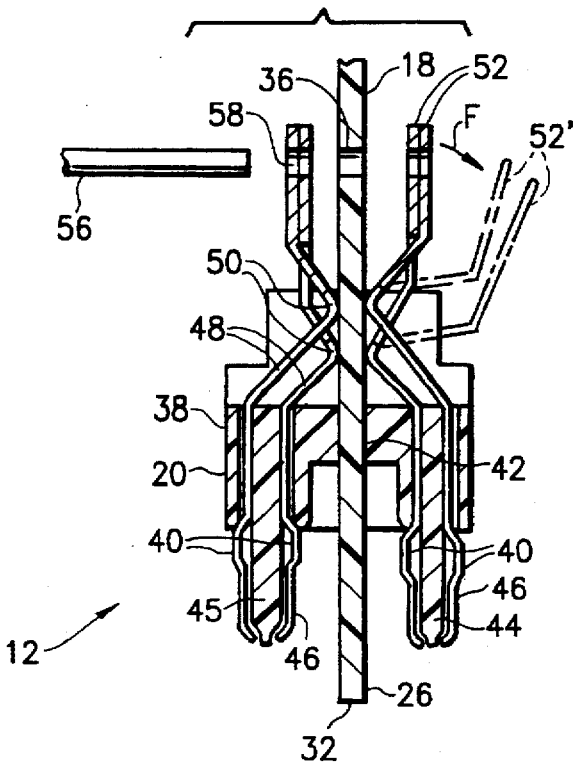
FIG. 4 is a cross-sectional view of the assembly shown in FIG. 3 showing how the carry strips are removed.

The outrigger 20 comprises a single one-piece housing 38 and rows of contacts 40 mounted to the housing 38. The outrigger 20 is similar to the outrigger disclosed in U.S. Pat. No. 5,236,368 which is hereby incorporated by reference in its entirety. Referring also to FIGS. 3 and 4, the housing 38 has a slot 42. A portion of the card edge connection area 26 passes through the slot 42. Laterally offset on both sides of the slot 42 are two downwardly extending ledges 44, 45. As seen best in FIG. 4, the ledges 44, 45 are spaced from and parallel to the card edge connection area 26 of the daughter board 18. In the embodiment shown, the leading edge 32 of the daughter board extends down past the lower edges of the ledges 44, 45. The contacts 40 extend through the housing 38 with lower ends 46 extending along the ledges 44, 45 and upper ends 48 that extend above the main body of the housing 38. The upper ends 48 have contact areas 50 that are connected to the upper contact pads 30 of the daughter board 18.

During manufacture of the outrigger 20, the contacts 40 are manufactured on carry strips 52. These carry strips 52 are shown in FIGS. 3 and 4, but they are removed after the contacts 40 are soldered to the upper contact pads 30. More specifically, after the contacts 40 are inserted into the housing 38, the daughter board 18 is inserted into the slot 42. The housing 38 is then fixed to the daughter board 18 by fasteners 54 (see FIG. 1). Then, an alignment tool 56 is inserted in holes 58 in the carry strips 52 and holes 36 in the daughter board 18. The alignment tool 56 thus aligns the contact areas 50 with the contact pads 30. The contacts 40 are then soldered to the pads 30. When completed, the alignment tool 56 is removed and the carry strips 52 are broken-off of the assembly 12 as shown by arrow F in FIG. 4 and the broken-off carry strips 52' shown in dashed lines.

Figures 2A, 2B, 2C, 2D, 2E:
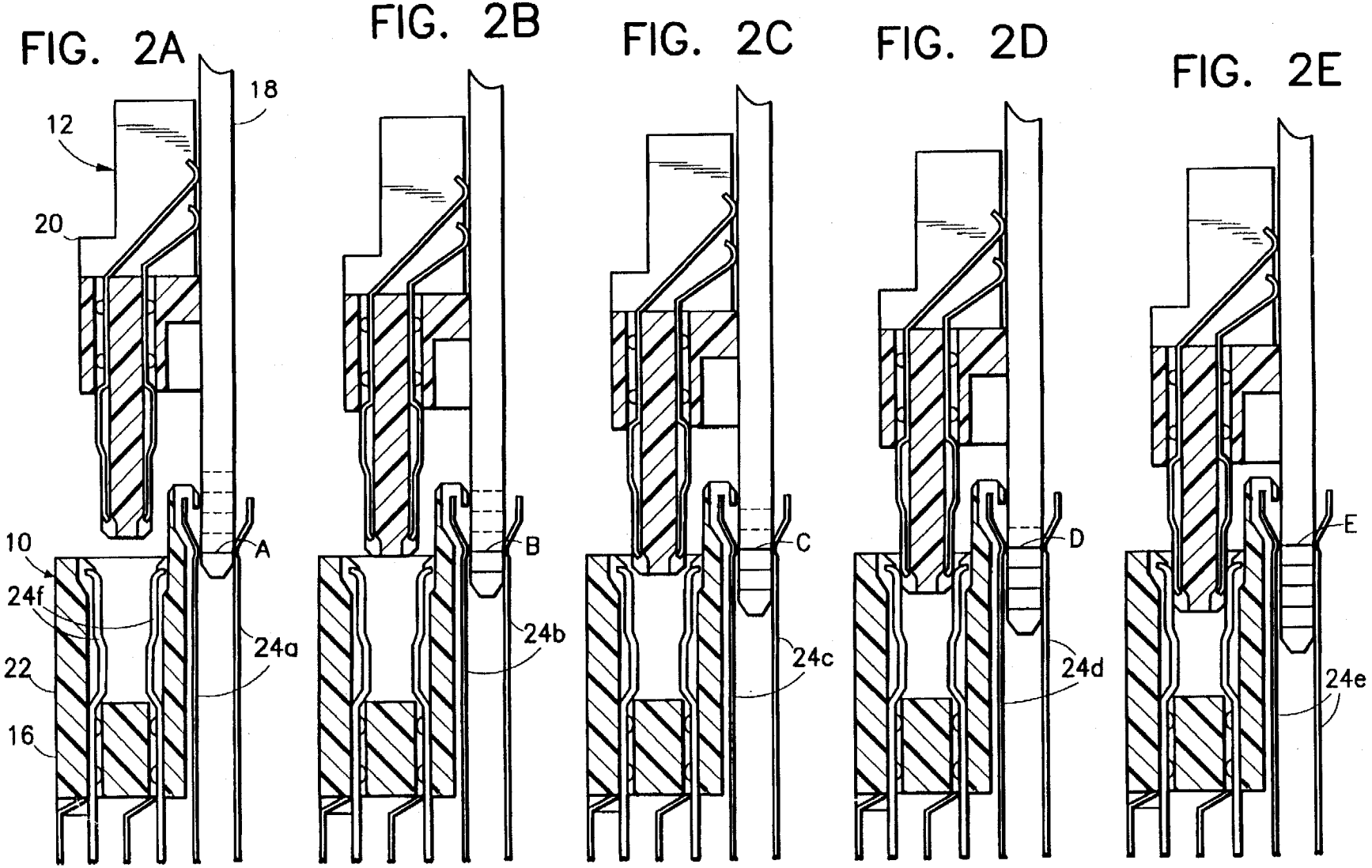
FIGS. 2A–2E are schematic partial cross-sectional views of portions of the electrical connectors and daughter printed circuit board shown in FIG. 1 at five different depths of insertion.

Referring now to FIGS. 2A–2E, a method used to connect the two components 10, 12 will be described. FIG. 2A shows the second component 12 being connected to the receptacle 16. As noted above, the daughter board 18 extends below the lower edges of the ledges 44, 45. Because the center portion 60 of the housing 22 extends above the rest of the housing 22, the daughter board 18 is inserted into the center row 66 of receiving areas before the rest of the component 12 is inserted into the receptacle 16. Line A indicates the location of the bottom edges of the ground contacts 28*a* on the daughter board 18. The ground contacts 24*a* in the center portion 60 make contact with the ground contact pads. This establishes a ground circuit to remove any static electricity. As shown in FIG. 2B, further insertion of the daughter board 18 to a second depth results in the precharge contacts 24*b* contacting the precharge contact pads 28*b*. Line B indicates the location of the bottom edges of the precharge contact pads 28*b* on the daughter board 18. The precharge contacts 24*b* make contact with precharge contact pad 28*b* after the ground contacts 28*a*, 24*a* are connected to each other, but before the rest of the contacts contact each other. This provides a low level of electricity to the daughter board 19 that is circuit controlled to prepare the daughter board 18 for full voltage when the contacts 24*c* and 28*c* are connected. As shown in FIG. 2C, further insertion of the daughter board 18 to a third depth results in the power contacts 28*c* being connected to the power contact pads 24*c*. Line C indicates the location of the bottom edges of the power contact pads 24*c*. The power contacts 24*c*, 28*c* make contact with each other after connection of the ground and precharge contacts, but before the rest of the contacts are connected to each other. As shown in FIG. 2D, further insertion of the daughter board 18 to a fourth depth results in the signal contacts 28*d* being connected to the signal contact pads 24*d*. Line D indicates that the location of the bottom edges of the signal contact pads on the daughter board 18. In addition, the signal contacts 40 on the outrigger 20 make contact with the signal contacts 24*f* in the two other rows 68 of receiving areas. As seen in FIG. 2E, further insertion of the second component 12 into the receptacle 16 brings the confirmation contact pad 28*e* into contact with the confirmation contact 24*e*. This allows a signal to be sent between the two components 10, 12 that all electrical connections have been made and the two components 10, 12 can now function with each other. In the embodiment shown, the sequential mating of the five different types of contacts allows a safe connection of the two components to each other and, confirms that the connection has been made. The distances between A, B, C, D and E are about 0.04 inch. However, any suitable spacing could be provided. More than five different types of contacts could also be provided. Further insertion of the component 12 into the receptacle 16 of about 0.18 inch results in full mating to mechanically mount the two components to each other. In this embodiment the outrigger contacts 40 and the outer row contacts 24 are adapted to make a redundant contact with each other similar to that shown in U.S. Pat. No. 5,098,311 which is hereby incorporated by reference in its entirety.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A method of mechanically and electrically connecting a first electronic component to a second electronic component by inserting a portion of the second component into a receptacle of the first component, the method comprising steps of:

connecting a first ground contact of the second component with a first ground contact of the first component as the second component is inserted into the receptacle to a first depth of insertion;

connecting a second precharge contact of the second component with a second precharge contact of the first component as the second component is inserted into the receptacle to a second depth of insertion;

connecting a third power contact of the second component with a third power contact of the first component as the second component is inserted into the receptacle to a third depth of insertion;

connecting fourth signal contacts of the second component with fourth signal contacts of the first component as the second component is inserted into the receptacle to a fourth depth of insertion; and connecting a fifth insertion confirmation contact of the second component with a fifth insertion confirmation contact of the first component as the second component is inserted into the receptacle to a fifth depth of insertion.

2. A method as in claim 1 wherein the second component comprises a daughter printed circuit board and an outrigger edge connector and, the steps of connecting the first, second, third, fourth and fifth contacts comprise inserting a card edge connection area of the daughter board into the receptacle.

3. A method as in claim 2 wherein the step of connecting fourth signal contacts comprises inserting portions of the outrigger edge connector into the receptacle.

4. A method as in claim 1 wherein the first, second, third, fourth and fifth depths of insertion are about 0.04 inch apart.

5. A method as in claim 1 wherein during insertion of the portion into the receptacle, contacts of the second component that are connected with contacts of the first component stay connected for the remainder of the insertion.

6. A method of connecting a daughter printed circuit board to a mother printed circuit board comprising steps of:

inserting a card edge connection area of the daughter board and an outrigger edge connector attached to the daughter board into a receptacle connector mounted on the mother board; and sequentially connecting at least five different types of contact pads on the card edge connection area to spring contacts in the receptacle connector at five depths of insertion into the receptacle connector.

7. A method of attaching upper contact areas of contacts on an outrigger edge connector with upper contact pads on a daughter printed circuit board comprising steps of:

providing the outrigger edge connector with a one-piece contact array having contacts with their upper contact areas connected to at least one carry strip of the one-piece contact array;

connecting the outrigger edge connector to the daughter board;

aligning the carry strip with the daughter board and thereby aligning the upper contact areas with the upper contact pads on the daughter board;

soldering the upper contact areas to the upper contact pads; and removing the carry strip from the contacts after the upper contact areas are soldered to the upper contact pads.

8. A method as in claim 7 wherein the step of aligning the carry strip comprises placing an aligner through holes in the carry strip and the daughter board.

9. A combined daughter printed circuit board and outrigger connector assembly comprising:

a daughter board having a card edge connection area; and an outrigger connector connected to the daughter board, the outrigger connector having a housing and a plurality of electrical contacts, the housing being comprised of a one-piece member with a slot having a portion of the daughter board passing therethrough and at least one ledge spaced from and parallel to the card edge connection area, the electrical contacts extend down alongside the at least one ledge wherein the one-piece housing member is located at opposite sides of the daughter board at the slot.

10. An assembly as in claim 9 wherein the housing has two ledges, each one of the ledges being on different sides of the card edge connection area.

11. An assembly as in claim 9 wherein the housing has end portions at ends of the card edge connection area.

* * * * *